US005932037A

United States Patent [19]

Holroyd et al.

[11] Patent Number: 5,932,037

[45] Date of Patent: Aug. 3, 1999

[54] METHOD OF MAKING HOLLOW BODIES

[75] Inventors: Nigel John Henry Holroyd, Riverside, Calif.; Warren Hepples, Bloxham, United Kingdom

[73] Assignee: Luxfer Group Limited, Manchester, United Kingdom

[21] Appl. No.: 08/545,669

[22] PCT Filed: Apr. 15, 1994

[86] PCT No.: PCT/GB94/00798

§ 371 Date: Jan. 29, 1996

§ 102(e) Date: Jan. 29, 1996

[87] PCT Pub. No.: WO94/24326

PCT Pub. Date: Oct. 27, 1994

[30] Foreign Application Priority Data

Apr. 15, 1993 [GB] United Kingdom ..... 93302931

[51] Int. Cl.[6] ..... C22C 21/10

[52] U.S. Cl. ..... 148/689; 148/690; 148/550

[58] Field of Search ..... 148/690, 550

[56] References Cited

U.S. PATENT DOCUMENTS 3,984,259 10/1976 Rodger et al. .

4,439,246 3/1984 Develay et al. ..... 148/2

FOREIGN PATENT DOCUMENTS 020282 12/1980 European Pat. Off. .
070790 1/1983 European Pat. Off. .
081441 6/1983 European Pat. Off. .
257167 3/1988 European Pat. Off. .
368005 10/1989 European Pat. Off. .
375571 6/1990 European Pat. Off. .
1554106 10/1979 United Kingdom .

OTHER PUBLICATIONS

Chemical abstract 103:108796 Oct. 1985 Balasubramanian.
Sanders et al. Met Trans v. 9A Aug. '78 pp. 1087–1100.

*Primary Examiner*—Patrick Ryan
*Assistant Examiner*—M. Alexandra Elve
*Attorney, Agent, or Firm*—Cooper & Dunham LLP

[57] ABSTRACT

A method of making a pressurized gas cylinder comprises providing an ingot of composition (in wt %); Zn 5.0–7.0; Mg 1.5–3.0; Cu 1.0–2.7; recrystallization inhibitor 0.05–0.40; Fe up to 0.30; Si up to 0.15; other impurities up to 0.05 each and 0.15 in total, balance Al of at least commercial purity, if necessary homogenizing the ingot at a temperature of at least 470° C. and for a time sufficient to reduce the volume fraction of S phase to a value below 1.0%, extruding the ingot preferably by cold backward extrusion, and forming and over-aging the resulting pressurized gas cylinder.

14 Claims, 4 Drawing Sheets

METHOD OF MAKING HOLLOW BODIES

FIELD OF THE INVENTION

This invention relates to a method of making a hollow body for a pressure container, using an aluminium alloy of the 7000 series. The method is particularly suitable for the manufacture of high pressure gas cylinders. There is currently competition between manufacturers of pressurised gas cylinders in aluminium, steel and composite materials.

BACKGROUND OF THE INVENTION

Basic requirements of materials for use in pressurised gas containment systems include: providing adequate fabricability to allow manufacture of the system and the capability to provide adequate strength, ductility, toughness, corrosion resistance, and resistance to all forms of time-dependence degradation of mechanical properties in the final product.

In the past, these requirements have restricted the use of aluminium alloys in commercial gas cylinders to those with peak strengths below about 450 MPa. An ill-fated attempt to exceed this strength level was made in the early 1970s, when a 7000 series aluminium alloy gas cylinder was introduced into the marketplace and resulted in the recall of all cylinders due to severe stress corrosion cracking initiating after limited service life that eventually would have led to catastrophic failures.

U.S. Pat. No. 4,439,246 (Gerzat) describes a method of making pressurised gas cylinders from 7475 alloy. A billet of the alloy was homogenised for 12 hours at 465° C.; hot (or alternatively cold) extruded; necked; solution annealed and quenched; and finally aged by the two step tempering type T73 treatment.

European Patent specification 257 167 (Gerzat) reports that the products (of the aforesaid U.S. patent) were found to be unsuitable after extensive testing, despite their very high level of fracture toughness, their good mechanical strength and excellent stress corrosion resistance in the T73 condition. The problem is solved, according to the European patent specification, by use of an alloy comprising 6.25–8.0% Zn; 1.2–2.2% Mg; 1.7–2.8% Cu; 0.15–0.28% Cr; and Fe+Si preferably <0.25%. As-cast billets of this composition are subjected to hot backward extrusion; drawing; necking; solution heat treating and quenching; and precipitation heat treating to a variety of over-aged conditions.

There is a need for pressurised gas cylinders with a higher strength to weight ratio, and in which any failure is preferably confined to the cylindrical part and does not spread to or occur at either the base or the shoulder.

SUMMARY OF THE INVENTION

The present invention provides a method of making a hollow body for a pressure container, which method comprises providing a billet of composition (in wt %)

| | |
|---|---|
| Zn | 5.0–7.0 |
| Mg | 1.5–3.0 |
| Cu | 1.0–2.7 |
| Recrystallisation inhibitor | 0.05–0.4 |
| Fe | up to 0.30 |
| Si | up to 0.15 |
| other impurities | up to 0.05 each and 0.15 in total, |
| Al | balance |

-continued said billet having a volume fraction of S phase below 1.0%
extruding the billet,
forming the extrusion into the shape of the desired hollow body, and
over-ageing the hollow body.

Preferably the alloy has the following composition:

| | |
|---|---|
| Zn | 5.0–7.0 |
| Mg | 1.5–2.5 |
| Cu | 1.8–2.2 |
| Cr and/or Zr | 0.10–0.25 |
| Fe | up to 0.15 |
| Si | up to 0.08 |

The Zn concentration is 5–7%. If the Zn concentration is too low, the alloy lacks the strength necessary to permit overageing. If the Zn content is too high, the alloy is difficult to cast by direct chill casting techniques, and the cast product is brittle and difficult to age in order to increase toughness. Alloys with higher Zn contents require higher extrusion pressures, and thus increased extrusion press costs and maintenance.

Mg acts in combination with Zn to increase hardness.

The Cu content is 1.0–2.7%, preferably 1.8–2.2%. Cu is required to permit overageing to give stress corrosion resistance. The formation of an undesired S-phase (of composition $CuMgAl_2$) increases with increasing Cu content, but can be dealt with by homogenisation of the cast ingot (as discussed below).

Cr and/or Zr is used as a recrystallisation inhibitor during solution heat treatment. An excessively high concentration of this component would spoil the fracture toughness. Alloys containing Cr, when compared to corresponding alloys containing Zr: require less critical control of homogenisation conditions, and lower extrusion pressures which reduce the problem of lubrication; and are accordingly preferred. Pressure containers containing Cr as a recrystallisation inhibitor have the additional advantage of excellent resistance to sustained load cracking. Other transition metal recrystallisation inhibitors such as Mn, V, Hf, Sc are possible but non-preferred alternatives which can be used alone or in combination with each other and/or with Cr and/or Zr.

Fe and Si are normally present in Al alloys. But their presence in these alloys is not desired, and their concentration needs to be controlled. Alloys containing excessively high concentrations of Fe and Si are known to have reduced toughness and also reduced corrosion resistance. Fe tends to precipitate in combination with Cu and Al thereby reducing the amount of S phase present. However, the Fe bearing precipitates do not redissolve during homogenisation and their presence reduces fracture toughness. Cylinders having excellent fracture and burst characteristics are obtained when the Fe content is no more than 0.10%.

Other known components, e.g. B, may be incorporated in the alloy in usual amounts. Be may be used (where permitted) for oxidation control. Ti may be added as a grain refiner to provide a preferred concentration of 0.02–0.07% in the final product. Apart from incidental impurities, the balance is Al of at least commercial purity, although high purity 99.9% Al may be preferred.

DETAILED DESCRIPTION OF THE PREFERRED EMBODIMENTS

In the following description of the fabrication procedure according to this invention, the steps of homogenising the cast ingot; extrusion; and final ageing, are of particular importance.

An alloy of the desired composition is cast, preferably by direct chill casting although spray deposition (WO 91/14011) is possible for alloys with high solute levels. The melt may optionally be filtered and degassed prior to casting. The cast billet is then stress relieved and homogenised, if necessary to bring the volume fraction of S phase to a value below 1.0%. Homogenisation may not be necessary for spray deposited alloys.

Figure 1:
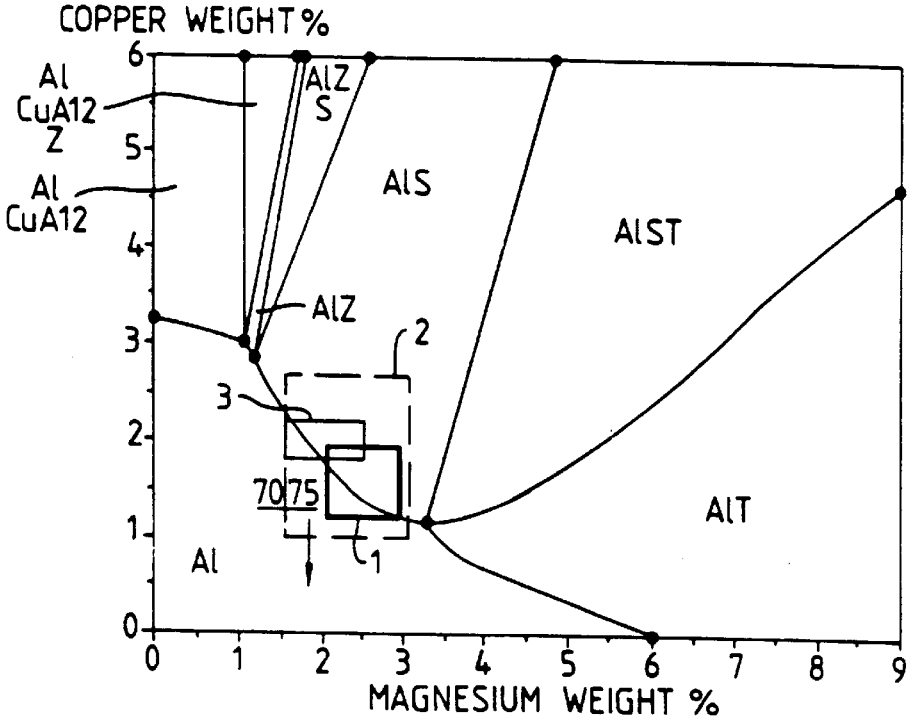
FIG. 1 is an isothermal section through a phase diagram taken at 460° C. of a DC cast Al alloy containing 6 wt % Zn and various concentrations of Cu and Mg.

FIG. 1 is an isothermal section through a phase diagram taken at 460° C. of a DC cast Al alloy containing 6 wt % Zn and various concentrations of Cu and Mg.

Referring to FIG. 1, the rectangular box 1 represents the 7075 alloy; box 2 represents alloys according to this invention; and box 3 represents preferred alloys according to this invention. The phase field in the bottom left hand corner of the diagram marked Al denotes compositions where the matrix contains Al with all of the Zn, Cu, Mg in solution. The field marked AlS contains S-phase precipitate (composition $CuMgAl_2$) in an Al alloy matrix. (See Met. Trans., Vol 9a, Aug 1978, p 1087–1100). The other fields contain other phases not important in the present context. The compositions of the three marked boxes straddle the Al/AlS boundary, and the same is true of the compositions of the two above Gerzat patents (which have not been shown to avoid confusing the diagram). Segregation of elements in the as-cast metal results in the presence of S phase precipitate in all of the unhomogenised alloys. Higher Zn levels (above 6%) tend to reduce the AlS field giving a slightly smaller amount of S phase. Higher temperatures (above 460° C.) tend to reduce the AlS field.

During homogenisation, the excess S phase dissolves, but this is a very slow process at low homogenising temperatures. Most of the S phase is dissolved after 12 hours at 475° C., but after the same time at the lower temperature of 465° C. a substantial proportion of this phase remains undissolved. Homogenising conditions depend to a small extent on billet size. These figures relate to 229 mm diameter ingot. Larger billet would require somewhat higher temperatures and/or longer holding times. After homogenisation, dissolved S phase does not re-precipitate to any significant degree on air cooling to room temperature.

The presence of S phase reduces the fracture toughness of the alloy. Figures obtained on 7150 alloy plate suggest that samples containing 0.25 volume % of S phase have an average fracture toughness of 60 $MNm^{-3/2}$, while samples with 0.15 volume % of S phase have an average plane stress ($K_{app}$) fracture toughness of 75 $MNm^{-3/2}$.

For the above reason, it is a critical feature of the invention that the ingot has a low volume fraction of S phase, e.g. by having been homogenised at a temperature of at least 470° C. and for a time sufficient to reduce the volume fraction of S phase to a value below 1.0%. Preferably the homogenisation temperature is about 475° C. Liquation of the S phase takes place at 488° C. Preferably the heating rate at temperatures above 460° C. is no more than 10°/hour, and above 475° C. is no more than 3°/hour, so as to avoid the risk of undesired liquation.

The ingot is held at homogenising temperature for a time to reduce the S phase to a desired low level, usually below 0.2 volume %, preferably below 0.1 volume % and desirably approaching zero. Preferably the ingot is held at homogenising temperature for at least 2 hours, e.g. 12 hours, with longer times required at lower temperatures.

After homogenising, the ingot may be air cooled to room temperature. Cooling is preferably effected at a controlled rate below 200° C./hour. Preferably, cooling is interrupted for 1 to 48 hours at a hold temperature in the range 200–400° C.; or cooling may be continuous at a rate of about 10° C. to 100° C. per hour through this temperature range. These conditions may reduce the press loads required for extrusion.

These homogenising schedules are designed to ensure that substantially no S phase remains in the ingot, thus improving the fracture toughness properties of the extruded product; and that the ingot is in the softest possible state, thus minimising the extrusion pressure required.

The homogenised ingot may be scalped to remove some or all of the shell and all the shuts, and is then cut up into billets for extrusion.

Although hot extrusion according to the invention is possible, cold or warm extrusion is preferred as being a lower cost procedure. Cold or warm extrusion may also give rise to an extrudate having a better combination of strength and toughness properties. Warm extrusion is typically performed with a starting billet temperature at 100–250° C. to avoid hot shortness. Cold extrusion is typically performed with a starting billet temperature at below 100° C. e.g. at ambient temperature. The preferred technique is backward extrusion. This technique involves the use of a recess, generally cylindrical, with parallel side walls, and a ram to enter the recess, dimensioned to leave a gap between itself and the side walls equal to the desired thickness of the extrudate. An extrusion billet is positioned in the recess. The ram is driven into the billet and effects extrusion of the desired hollow body in a backwards direction. The forward motion of the ram stops at a distance from the bottom of the recess equal to the desired thickness of the base of the extruded hollow body. Extrusion speed, the speed with which the extrudate exits from the recess, is not critical but is typically in the range 50–500 cm/min. Lubrication can substantially reduce the extrusion pressure required.

The initial extrudate is cup-shaped, with a base, parallel side walls and an open top. The top is squared off and heated, typically induction heated to 350–450° C., prior to the formation of a neck by swaging or spinning. The resulting hollow body is solution heat treated. Conditions are not critical but may typically be 15–90 minutes at 475° C. Solution heat treatment is followed by quenching, generally into cold water.

After solution heat treatment and quenching, the hollow body is aged. The alloy composition has been chosen such that the peak aged strength is substantially higher than necessary, and this enables the body to be overaged to an extent to develop desired properties, particularly fracture toughness and tear resistance but also fatigue strength, and slow crack growth, creep, and stress corrosion resistance. Tear resistance is defined as the energy required to keep a crack growing and may be measured by the Paris toughness index (Mechanics and Physics of Solids, Vol 26, 1978, p 163). Ageing may preferably be effected to an extent to reduce the mechanical properties (in comparison with a peak aged product) by 10 or 15–30% e.g. about 20%. Various ageing temperatures, from 160–220° C., and times, from 1–48 hours, may be necessary to achieve this. Top ageing temperatures of 175–185° C. for 2–24 hours are likely. These may be preceded by pre-ageing at 80–150° C. typically for 1–24 hours, and/or followed by post-ageing at 80–150° C. typically for 1–48 hours. Duplex and/or Triplex ageing may also improve tear resistance and yield strength.

It is known that homogenising treatments reduce the amount of second phase particles present in 7000 series alloys, and that this can increase the fracture toughness in products that have been hot worked e.g. by hot rolling or hot extrusion. But most parts of the hollow bodies produced according to the present invention are never hot worked. In fact, there is a substantial difference between the kind and extent of the work performed on different parts of the hollow body:

- The walls, are heavily cold or warm worked during the extrusion process.
- The base, by contrast, is less deformed and can retain recognisable aspects of the cast and homogenised microstructure.
- The neck of the hollow body is formed by hot working the walls which themselves have been cold or warm worked; a reverse of the usual procedure which involves hot working followed by cold working.

These variations in working conditions produce profoundly different microstructures in different parts of the hollow body, and the method of this invention is a compromise designed to generate adequate properties in all parts.

Similarly, overageing is known to increase fracture toughness and stress corrosion resistance in products which have been hot worked. But it was not obvious that a given overageing treatment would be beneficial (or at least not harmful) for all the different microstructures in the hollow bodies made according to this invention.

Experimental

In a preliminary experiment, commercial 7150 alloy plate was overaged using a variety of heat treatments to a yield strength of around 450 MPa and then subjected to toughness testing. The test results are set out in Table 1 and show that the alloy fracture toughness and tearing resistance could be made adequate for use in pressure vessel applications.

TABLE 1

Short transverse properties of 25 mm thick 7150-T651 plate after resolution heat-treatment (1 hr at 475° C.) and cold water quench followed by various ageing practices.

| Ageing Treatment | Yield Stress ($MNm^{-2}$) | $K_Q$ ($MNm^{3/2}$) | $J_{1c}$ ($KJm^{-2}$) | $\frac{dJ}{da}$ ($MJm^{-3}$) |
|---|---|---|---|---|
| 10 hr 110° C. + 8 hr 180° C. | 400 | 62 | 50 | 33 |
| 16 hr 110° C. + 2 hr 200° C. | 440 | 56 | 41 | 20 |
| 2 hr 200° C. 16 hr 110° C. | 445 | 50 | 36 | 18 |

EXAMPLE 1

A 7000 series alloy with a nominal composition of 6% Zn, 2% Mg, 2% Cu was cast on a high purity base (<0.06% Fe and <0.04% Si) Al alloy in two versions, one containing 0.2% Cr and the other 0.1% Zr. Alloy composition is set out in Table 2. Homogenisation conditions are set out in Table 3. Billets were fabricated into pressurised gas cylinders 175 mm external diameter and 7.9 mm nominal wall thickness, according to a schedule as described above and corresponding to standard practice except that an additional anneal was introduced prior to cylinder heading via a hot swaging process. Mechanical properties of the resulting pressurised gas cylinders are set out in Table 4 for material taken from three different locations. The chosen locations, neck/shoulder, wall and base, cover the typical alloy microstructures generated in an aluminium gas cylinder. The results (Table 4) indicate that it is possible for a given heat treatment to provide the balance of properties needed for a safe cylinder despite there being several alloy microstructures involved. Trial cylinders (the Cr alloy formulation) have been subjected to real-life atmospheric corrosion in a marine environment and to laboratory corrosion testing (galvanostatic) and conditions stipulated in the EEC corrosion test for high pressure aluminium gas cylinders. Results from all the corrosion tests indicate that the cylinders under test have a corrosion resistance at least as good as commercial 6000 series cylinders and should therefore provide an adequate performance in service. These results are believed surprising, because 6000 series alloys such as 6061 and 6082 are used unprotected in marine applications such as helidecks on North Sea offshore oil platforms and are considered to have a good corrosion resistance, whereas

TABLE 2

7000 SERIES ALLOY COMPOSITIONS IN WT %

| | | Zn | Mg | Cu | Cr | Zr | Fe | Si |
|---|---|---|---|---|---|---|---|---|
| Trial 1 | | 6.23 | 2.06 | 2.00 | 0.22 | — | 0.06 | 0.03 |
| | | 6.14 | 2.07 | 2.00 | — | 0.12 | 0.06 | 0.03 |
| Trial 2 | | 5.79 | 1.92 | 1.80 | 0.2 | — | 0.06 | 0.03 |
| | | 5.76 | 1.92 | 1.79 | — | 0.14 | 0.05 | 0.03 |
| Trial 3 | A | 5.60 | 1.84 | 1.62 | 0.19 | — | 0.06 | 0.03 |
| | B | 5.96 | 2.01 | 1.87 | 0.20 | — | 0.06 | 0.03 |
| | MIN | 5.2 | 1.9 | 1.2 | 0.18 | | | |
| 7475 | | | | | | <0.05 | 0.12 | 0.1 |
| | MAX | 6.0 | 2.6 | 1.9 | 0.25 | | | |
| | MIN | 5.9 | 2.0 | 1.9 | | 0.08 | | |
| 7150 | | | | | 0.04 | | 0.15 | 0.12 |
| | MAX | 6.9 | 2.7 | 2.5 | | 0.15 | | |

TABLE 3

| Homogenization Treatments | |
|---|---|
| Trial 1 | 24 hrs 485° C. Air Cool.<br>(Zr-containing alloy given additional<br>16 hr 300° C. + slow cool 50° C./hr). |
| Trial 2 | Cr-containing alloy:<br>30 → 460° C. (100° C./hr) 460 → 475° C. (5° C./hr)<br>475 → 485° C. (2° C./hr). 24 hr hold at 485° C.<br>Air cool → RT.<br>Zr-containing alloy:<br>As above but controlled cool down<br>485 → 300° C. (25° C./hr) 8 hr hold at 300° C.<br>Air cool → RT. |
| Trial 3 | FAST = As for Cr-containing alloy in Trial 2 but 475 →<br>480° C. (2° C./hr) and 480 → 485° C. (1° C./hr).<br>SLOW = As for Zr-containing alloy in Trial 2<br>but 16 hr hold at 300° C. during cool down. |

TABLE 4

Mechanical properties for Cr-containing
Trial 1 gas cylinders aged 5 hr at 180° C.

| 0.2% PS (MPa) | UTS (MPa) | ELONG (%) | $K_Q$ ($MNm^{3/2}$) | Cylinder Location |
|---|---|---|---|---|
| 470 | 522 | 13.5 | — | WALL |
| 457 | 508 | 18.0 | 41.2 | BASE |
| 460 | 511 | 13.5 | 40.3 | NECK/SHOULDER |

7000 series alloys, especially those containing above 0.5% Cu, are generally regarded as having a poor corrosion resistance in saline environments.

EXAMPLE 2

In an attempt to reduce the extrusion press loads required during cylinder shell fabrication, the alloy composition for trial 2 was made slightly leaner in Zn and Mg (Table 2) and the homogenisation practice employed was further optimised (Table 3). This approach proved successful with the required extrusion press loads during cylinder shell production being consistently lower than those associated with trial 1 (Table 5). Moreover as was observed in trial 1, the loads for the Cr containing alloy were significantly lower than for the Zr containing alloy. The importance of this difference was clearly shown in trial 2, where all 27 alloy billets of the Cr containing alloy presented to the press were successfully extruded into shells, whereas only half of the 18 Zr containing alloy billets were extruded prior to the high tooling loads leading to unacceptable distortion and a termination of the trial. These problems could have been overcome by warm extrusion or by using stronger tools or improved lubrication.

On the basis of these observations, the Cr based alloy is preferred as providing a) softer as-homogenised material with a reduced tendency for subsequent hardness increases via natural ageing which thereby required lower press loads during extrusion, and b) fabricated cylinders with higher toughness. This preference for Cr-containing alloys is contrary to a trend in high strength 7000 series alloy developments, which has moved away from Cr containing alloys such as 7075, 7175 and 7475, towards Zr containing alloys e.g. 7050, 7150 and 7055, because the latter are less quench sensitive and are considered to provide material with potentially higher fracture toughness.

TABLE 5

EXTRUSION PRESS LOADS DURING 7000 SERIES CYLINDER TRIALS

| Alloy | Load kN × $10^3$ |
|---|---|
| Cr-containing Alloy | |
| Trial 1 | 25.8 |
| Trial 2 | 22.6–23.9 |
| Trial 3 | 21.9–24.8 |
| Zr-containing Alloy | |
| Trial 1 | 26.8–27.7 |
| Trial 2 | 24.5–26.5 |

After ageing for 5 hours at 180° C., pressurised gas cylinders from this trial were subjected to the EEC corrosion test, in which coupons from shoulder, wall and base were exposed to acidified chloride solution for 72 hours. All samples passed the test. No intergranular corrosion was seen, only crystallographic general attack evident.

The cylinders were also subjected to the EEC stress corrosion cracking (SCC) test (EEC Specification No. L300/41). Hoops from the cylinder wall were subjected to both C-ring tensile and compressional tests. The samples were loaded to a stress level of 0.2% proof stress/1.3. The test environment was 3.5% NaCl solution and exposure was alternate immersion conditions (ASTM G44-75) for 30 days. The air temperature was 27° C. and the relative humidity 45%. All samples tested completed the 30 day test period without cracking, and hence are considered suitable, in terms of resistance to SCC, for the manufacture of gas cylinders.

Further work was completed to examine the SCC susceptibility of the cylinder shoulder material using even more severe test methods. Smooth tensile samples were prepared from the shoulder material with a circumferential orientation and subjected to a breaking load test programme (E. L. Colvin and M. R. Emptage, "The Breaking Load Method: Results and Statistical Modification from the ASTM Interlaboratory Test Program" in New Methods for Corrosion Testing Aluminium Alloys, ASTM-STP 1134, V. S. Agarwala and G. M. Ugiansky, Eds., American Society for Testing and Materials, Philadelphia, 1992, pp 82–100). Samples were tensile loaded to a specific stress level (see Table 6) and subjected to a 3.5% NaCl solution under alternate immersion conditions (as discussed previously). After 7 days the samples were removed from the test environment, unloaded and pulled to failure in a conventional tensile test. Any reduction in the strength of the material would indicate a susceptibility to SCC, however, even those samples which were loaded to 90% of the 0.2% proof stress displayed an excellent resistance to SCC, Table 6.

TABLE 6

| CYLINDER IDENTIFICATION | TEST DURATION | APPLIED STRESS (MPa) | STRESS LEVEL | BREAKING LOAD (MPa) |
|---|---|---|---|---|
| A | 0 | / | / | 478/485 |
| | 7 | 208 | SERVICE PRESSURE | 462/500 |
| | 7 | 346 | TEST PRESSURE | 465/485 |
| | 7 | 375 | 90% 0.2% PS | 459/489 |
| B | 0 | / | / | 479/499 |

TABLE 6-continued

| CYLINDER IDENTI-FICATION | TEST DURA-TION | APPLIED STRESS (MPa) | STRESS LEVEL | BREAKING LOAD (MPa) |
|---|---|---|---|---|
| | 7 | 208 | SERVICE PRESSURE | 482/484 |
| | 7 | 346 | TEST PRESSURE | 468/491 |
| | 7 | 375 | 90% 0.2% PS | 472/472 |

The final column in Table 6, referring to 'Breaking Load' shows the results of two independent but nominally similar samples, i.e. environment, exposure time, and applied stress were identical for both samples tested.

Stress corrosion cracking in all the tests described above was initiated from smooth surfaces. Fatigue pre-cracked fracture mechanics type compact tension specimens taken from both cylinder bases and shoulders, Trial 2 alloy, have been used to characterise cylinder materials crack growth resistance for cracks initiating from pre-existing sharp cracks. For the chromium containing alloy cylinders, tests have been conducted using two environments:

a) a chromate-inhibited acidified aqueous saline environment at room temperature (2% sodium chloride+0.5% sodium chromate acidified to a pH of 3.5 using conc. HCl) (stress corrosion cracking) and b) laboratory air at 80° C. (sustained load cracking).

Samples (identified as Top 3 in FIGS. 2 and 3) were taken from the neck/shoulder region of a cylinder and notched so as to orientate the crack in the most susceptible direction. Further samples were taken from the base of the cylinder (identified as Base 2 in FIGS. 2 and 3) and notched in a radial direction away from the centre.

Figure 2A:
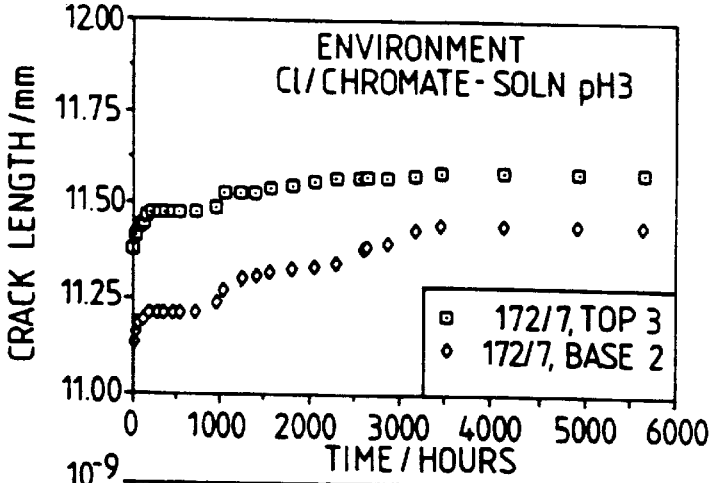
FIG. 2*a* is a graph of crack length against time, and shows crack extension in a double cantilever beam fatigue pre-cracked specimens.
Figure 2B:
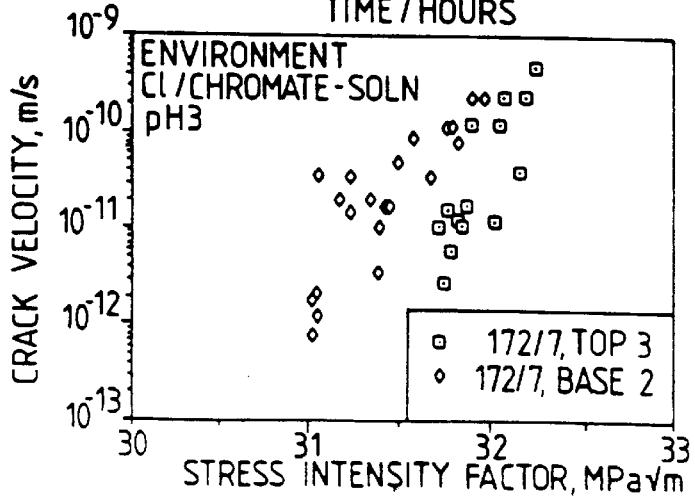
FIG. 2*b* is a graph of crack velocity against stress intensity factor calculated from the data shown in FIG. 2*a*.
Figure 3A:
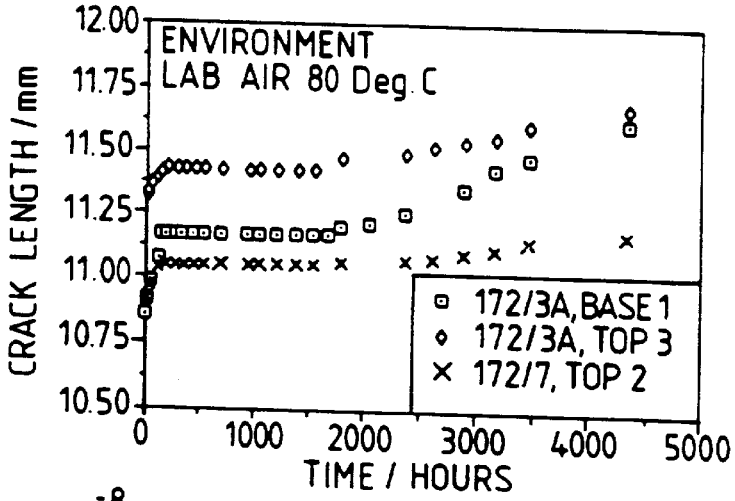
FIG. 3*a* is a graph of crack length against time and shows crack extension in a double cantilever beam fatigue pre-cracked specimen obtained in laboratory air at 80° C.
Figure 3B:
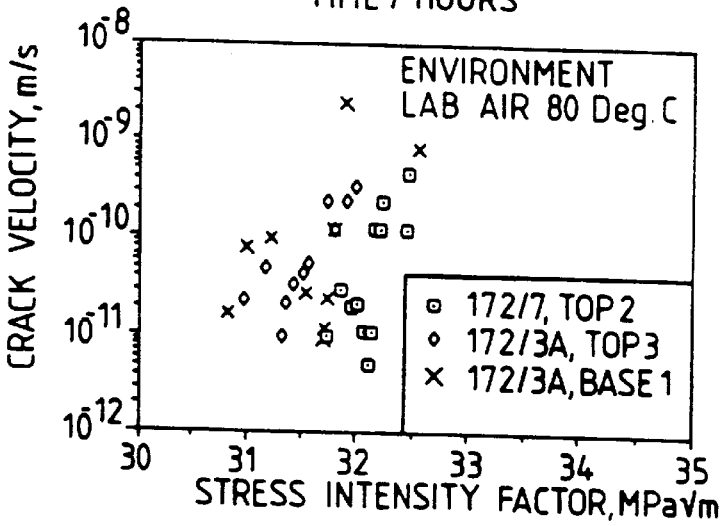
FIG. 3*b* is a graph of crack velocity against time calculated from the data shown in FIG. 3*a*.

In FIGS. 2*a*) and 3*a*), the data is presented in the form of crack growth as a function of time. In FIGS. 2*b*) and 3*b*), the crack growth rate data is presented as a function of stress intensity factor. The results for the Cr-containing alloy show that the crack growth rates fall below $10^{-13}$ m/s for stress intensity factors below 30 $MNm^{-3/2}$ and therefore the material from the chromium-containing alloy cylinders is extremely resistant to crack propagation via either stress corrosion cracking or sustained load cracking (SLC). Sustained load cracking is a relatively recently identified intergranular crack growth mechanism for precipitate hardening aluminium alloys (see Met. Trans. Vol 23A, pp 1679–1689, 1992).

EXAMPLE 3

On the basis of the information from the first two cylinder fabrication trials, a further trial (trial 3) was designed. This employed two versions of the Cr-containing 7000 series alloy, Table 2, which were homogenised using one of two practices, Table 3. All 47 billets presented to the extrusion press during trial 3 were successfully extruded and fabricated into gas cylinders with the same dimension as trials 1 and 2, i.e. 175 mm external diameter and 7.9 mm wall thickness. As expected the extrusion press loads increased with alloys Zn and Mg concentration, however the absolute value for a given alloy composition was lower in trial 3 than the two earlier trials. In addition the press loads for the experimental alloys were reduced when the homogenisation practice involved step cooling from the soak temperature and/or a lower extrusion ram speed during shell fabrication. The extrusion pressures and as-homogenised mechanical properties are reported in Table 7.

The pressurised gas cylinders were solution heat treated at 475° C. for one hour, cold water quenched, and aged at 180° C. for 4.5 hours, before being subjected to various tests. Two rings and four equal size bend strips were sectioned from each of six cylinders. Samples 18.1 mm wide and 175 mm long, were taken from 6 cylinders (cylinders A–F in Table 8) and subjected to bend tests. All samples bent around a mandrel with a diameter of 47.1 mm, did so without cracking.

Six cylinders were subjected to tensile tests, with the results set out in the following Table 8.

Two cylinders were subjected to a burst test, with the results set out in the following Table 9.

Three cylinders were subjected to fatigue tests at a fatigue test pressure of 343 Bar (34.3 MPa) with the results set out in Table 10.

TABLE 7

EXTRUSION PRESS TONNAGES AND AS-HOMOGENISED MECHANICAL PROPERTIES FOR 7000 SERIES ALLOYS USED IN TRIAL 3

| | | TENSILE PROPERTIES (AFTER HOMOGENISATION) | | | EXTRUSION | RAM |
|---|---|---|---|---|---|---|
| ALLOY I.D. (See Table 2) | HOMOGENISATION (See Table 3) | 0.2% PS (MPa) | UTS (MPa) | ELONG$^{H}$ (%) | PRESSURE MPa × $10^3$ | SPEED (mm/s) |
| A (5.6 Zn) | FAST | 102 | 237 | 18.6 | 1214 (±12.4) | 46.6 |
| | | | | | 1152 (±12.4) | 10.6 |
| | SLOW | 93 | 211 | 14.0 | 1177 (±37.2) | 46.6 |
| | | | | | 1144 (±14.3) | 14.8 |
| B (6.0 Zn) | FAST | 104 | 240 | 16.9 | 1227 (±12.4) | 46.6 |
| | | | | | 1198 (±14.3) | 14.8 |
| | SLOW | 96 | 222 | 16.2 | 1202 (±12.4) | 46.6 |
| | | | | | 1115 (±21.5) | 14.8 |

TABLE 8

| CYLINDER | HOMOGENI-SATION | YIELD STRENGTH (MPa) | ULTIMATE TENSILE STRENGTH (MPa) | ELONGA-TION (%) |
|---|---|---|---|---|
| A | FAST | 435 | 496 | 14.5 |
| B | SLOW | 429 | 490 | 15.0 |
| C | SLOW | 435 | 500 | 13.8 |
| D | FAST | 436 | 500 | 13.0 |

TABLE 9

| CYLINDER | HOMOGENISATION | EXTRUSION SPEED (mm/s) | HEADING SPEED (mm/s) | BURST PRESSURE (MPa) | FAILURE MODE |
|---|---|---|---|---|---|
| G | SLOW | 14.8 (SLOW) | 31.8 (FAST) | 51.7 | CENTER S/W |
| H | FAST | 14.8 (SLOW) | 10.6 (SLOW) | 49.7 | LOWER S/W |

TABLE 10

| CYLINDER | HOMOGENISATION | EXTRUSION SPEED (mm/s) | HEADING SPEED (mm/s) | NO. OF CYCLES TO FAILURE |
|---|---|---|---|---|
| L | FAST | 46.6 | 31.8 | 4040 |
| M | FAST | 10.6 | 31.8 | 4801 |
| N | FAST | 14.8 | 21.2 | 4888 |

EXAMPLE 4

Homogenising Practice

The compositions of the alloys used in this work are as shown in Table 11:

TABLE 11

| Alloy | Si | Fe | Cu | Mn | Mg | Cr | Ti | Zn | B |
|---|---|---|---|---|---|---|---|---|---|
| I | 0.06 | 0.09 | 2.06 | 0.003 | 2.04 | 0.20 | 0.024 | 5.99 | — |
| II | 0.04 | 0.06 | 1.95 | 0.003 | 1.91 | 0.20 | 0.028 | 5.87 | 0.001 |

Figure 4:
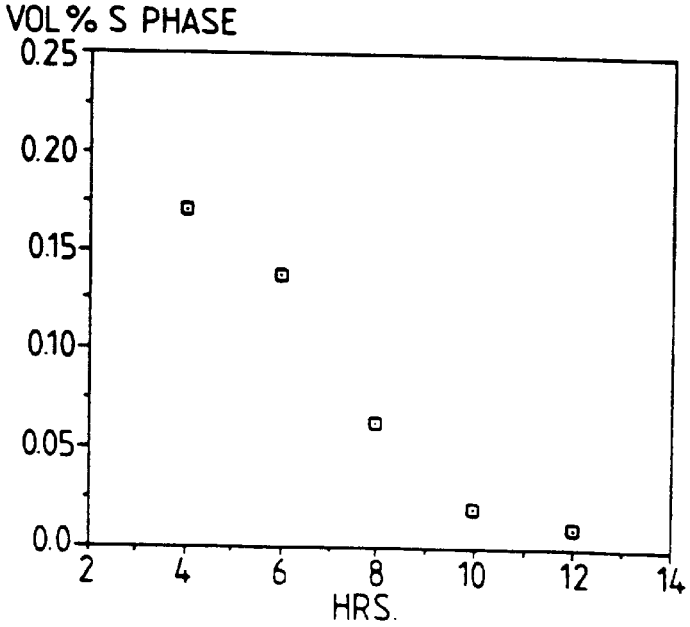
FIG. 4 is a graph showing variation in amount of S phase present with increasing time of homogenization at 475° C.

Samples from extrusion billet of alloy I having diameters up to 300 mm were examined by Differential Scanning Calorimetry (DSC) to determine the amount of S phase after homogenising at 465 or 475° C. for times up to 12 hours. It can be seen from FIG. 4 that times in excess of 7 hours at 475° C. would reduce S phase concentration to <0.1% by volume, while 12 hours at 475° C. would reduce S phase to almost zero.

Figure 5:
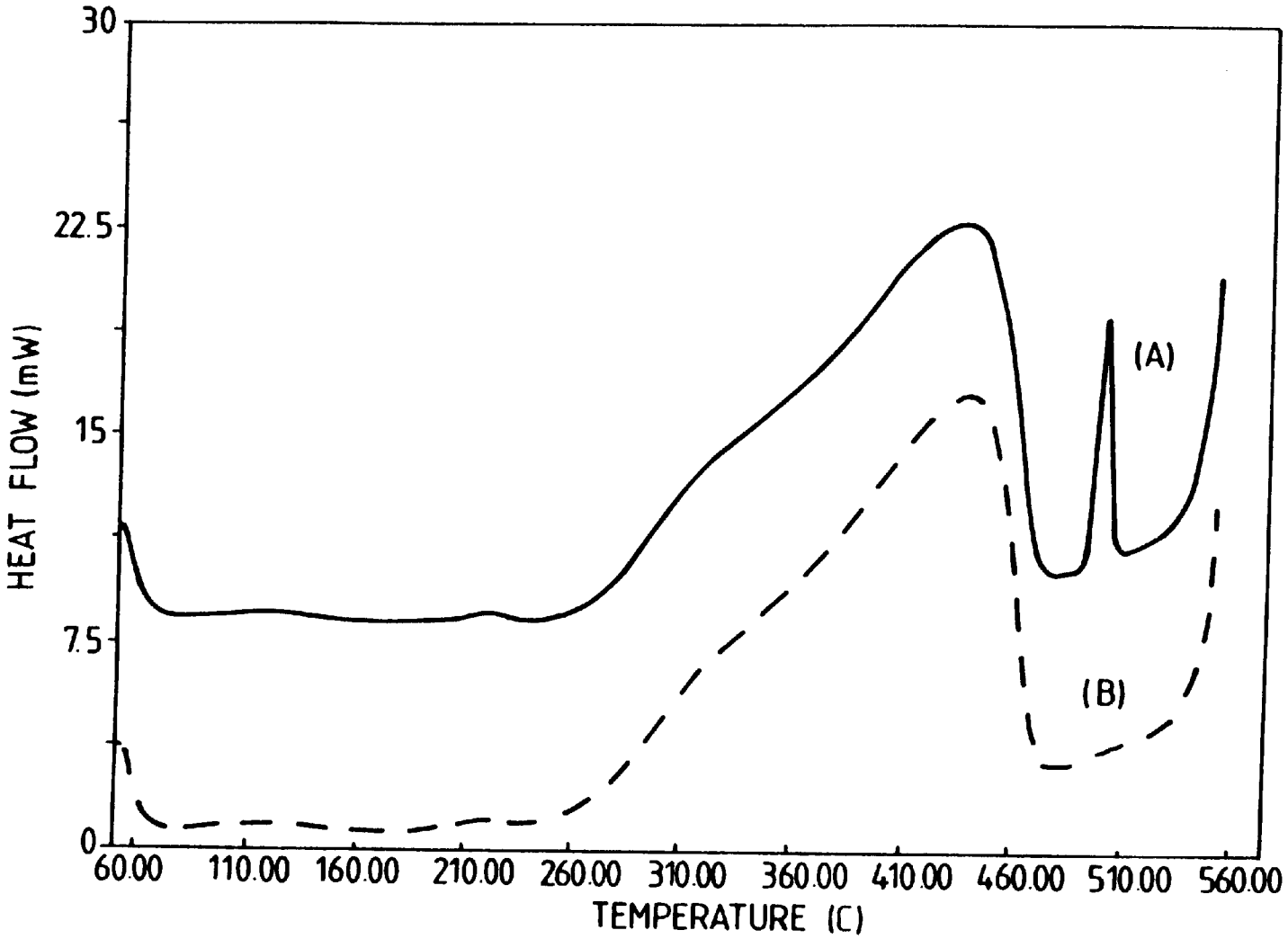
FIG. 5 shows differential scanning calorimetry traces on a billet after homogenizing for 12 hours at (A) 465° C. and (B) 475° C.

FIG. 5 is a plot produced by (DSC) comparing two billets homogenised for 12 hours at 475 and 12 hours at 465° C. respectively. The presence of S phase in the billet homogenised at the lower temperature is indicated by the peak adjacent to (A) and the area under the peak gives the vol % of S present—in this case 0.28 vol %. Absence of the peak in the other billet proves that there is no detectable S phase.

As a result a commercial homogenisation practice of 12 hours @475° C. has been selected for gas cylinder extrusion ingot, which not only shortens the time of the operation it reduces the risk of liquation (488° C.) and reduces the need for slow heating rates to the homogenisation temperature.

Gerzat (U.S. Pat. No. 4,439,246 1984) suggests it is possible to homogenise at 465° C. To reduce the S phase to acceptable limits at this low temperature would probably take in excess of 48 hours, and is not commercially feasible.

To demonstrate that 12 hrs at 475° C. provides an adequate homogenisation whereas 12 hrs at 465° C. does not, cylinders were manufactured from material having the above composition of alloy II with 3 different homogenisation practices (a) 12 hrs at 465° C., (b) 12 hrs at 475° C. and (c) 24 hrs at 485° C. All of the cylinders were subjected to the same fabrication procedure which included duplex ageing for 8 hours at 110° C. followed by 4.5 hours at 180° C. Although the burst pressure for all cylinders was similar their fracture mode was different, Table 12. The best fracture mode was exhibited by material which had been homogenised at 485° C., cylinders produced from material homogenised at 475° C. were only slightly inferior, whilst those cylinders produced from material homogenised at 465° C. exhibited least resistance to crack propagation and clearly failed the pass criteria required by the Gerzat Patent. The presence of S phase in the material homogenised at 465° C. undoubtedly affected cylinder performance.

TABLE 12

| 175 mm Dia. Cylinder | | | |
|---|---|---|---|
| Homogenisation Treatment | Burst Pressure MPa | Fracture Mode | UTS/σy (Elong %) |
| 12 hr 465° C. | 49.7 | Longitudinal crack total length of cylinder and through knuckle into base | 495/438 (13.5 ± 1.5) |
| 12 hr 475° C. | 50.0 | Longitudinal crack in barrel just to knuckle | 505/475 (17 ± 2.0) |
| 24 hr 485° C. + slow cool | 49.7 | Longitudinal crack contained within barrel | 500/447 (16.5 ± 0.5) |

Cooling from homogenisation temperature has an important effect on the extrudability of the billet. Flow stress, measured in plain strain compression, and the UTS both provide an empirical measure of extrudability; high values tending to indicate poor extrudability. The effects of four cooling practices were investigated after homogenising for 12 hours at 475° C.:

1. Air cool (about 200° C./hour).
2. Furnace cool (less than 100° C./hour).
3. Step cool (25° C./hour to 300° C. air cool).
4. 25° C./hour to 300° C. hold 16 hours air cool.

Figure 6:
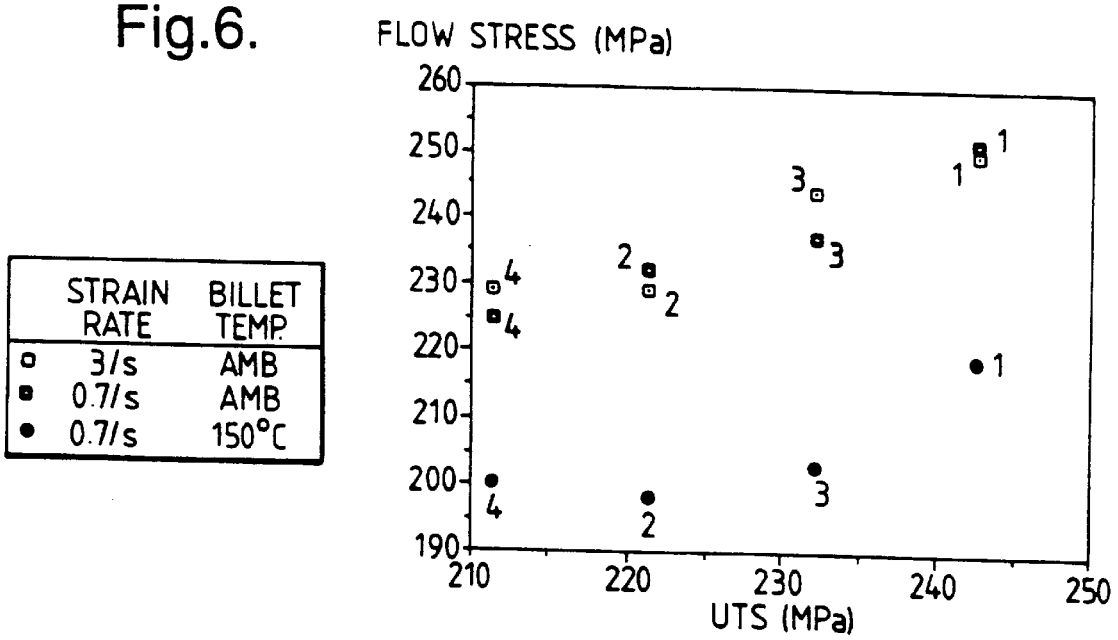
FIG. 6 is a graph showing relationship between flow stress and ultimate tensile strength for homogenized billets cooled in various ways.

The UTS was measured in a standard tensile test. The flow stress was measured by plain strain compression testing at two different strain rates 3/sec and 0.7/sec and at two different temperatures—ambient and, at the lower strain rate, 150° C. FIG. 6 shows the results for each set of conditions, the numbers against each point representing the cooling practice, from which it can be seen that the treatment '4' reduced the flow stress by about 10% and the UTS by about 10% and the UTS by about 15% with respect to air cooling. A similar reduction in flow stress can be achieved by cooling from homogenising temperature to RT at 25° C./hour. Lowering the UTS or the flow stress results in a reduction in extrusion pressure.

Raising the test temperature to 150° C. reduced the flow stress by about 15%. A corresponding reduction in extrusion pressure has been observed.

EXAMPLE 5

Effect of Fe Concentration on Cylinder Performance

Material was cast, 178 mm diameter, with four different Fe concentrations, Table 13:

TABLE 13

| Chemical Compositions (wt %) ELEMENT (wt %) | | | | | | | | |
|---|---|---|---|---|---|---|---|---|
| Si | Fe | Cu | Mn | Mg | Cr | Zn | Ti | B |
| 0.04 | 0.06 | 1.95 | 0.003 | 1.91 | 0.20 | 5.87 | 0.028 | 0.001 |
| 0.09 | 0.19 | 1.93 | 0.006 | 1.94 | 0.20 | 5.93 | 0.030 | 0.001 |
| 0.06 | 0.12 | 1.90 | 0.004 | 2.00 | 0.19 | 6.28 | 0.028 | 0.001 |
| 0.15 | 0.30 | 2.02 | 0.008 | 2.01 | 0.19 | 6.07 | 0.027 | 0.001 |

homogenised for 12 hrs at 475° C. and air cooled to room temperature. Cylinders, 175 mm diameter were produced. Cylinders were heat treated in a single batch, which consisted of a solution heat treatment at 475° C. for 1 hour, a cold water quench and a duplex age of 8 hrs @110° C. and 4.25 hrs @180° C.

It was noted that the iron concentration had a direct influence on 0.2% proof stress, Table 14, i.e. as the Fe level increased the 0.2% proof stress values decreased. This is due to the fact that Fe reduces the Cu available for the strengthening mechanism, i.e. Fe combines with Cu and Al to produce a deleterious second phase of composition e.g. $Cu_2FeAl_7$. Table 14 also shows results from burst tests which reveals that the highest burst pressures are achieved from cylinders with low Fe levels. Cylinders with low Fe levels yielded a single longitudinal crack which was retained within the cylinder barrel. The crack length increased such that cylinders with Fe concentrations above 0.12% exhibited cracking that extended outside the barrel into the base and/or shoulder regions. Based upon the observed cylinder burst and fracture characteristics the alloy content iron concentration is preferably not more than 0.10%.

TABLE 14

| [Fe] Wt % | Burst Pressure (Psi) | Fracture Mode | UTS/σy ($MNm^{-2}$) Elongation (%) |
|---|---|---|---|
| 0.06 | 7250 | Longitudinal crack in cylinder barrel | 505/475 (14.80) |
| 0.12 | 7300 | Longitudinal crack in cylinder barrel and through knuckle into base | 512/463 (14.97) |
| 0.19 | 7050 | As above (0.12 Fe) but + crack into neck and threads | 503/460 (14.64) |
| 0.30 | 6750 | As above (0.19 Fe) + crack branching | 481/431 (14.80) |

EXAMPLE 6

Effect of Ageing on Cylinder Properties

Gas cylinders in Trial 2 were investigated with respect to the effect of ageing practice on cylinder properties. All cylinders were solution heat treated for 1 hour at 475° C. and cold water quenched prior to ageing. The effect of two ageing practices were examined: (a) single ageing, which consisted of 4.5 hours @180° C. and (b) duplex ageing which was 8 hours @110° C. followed by 4.5 hrs @180° C.

Figure 7:
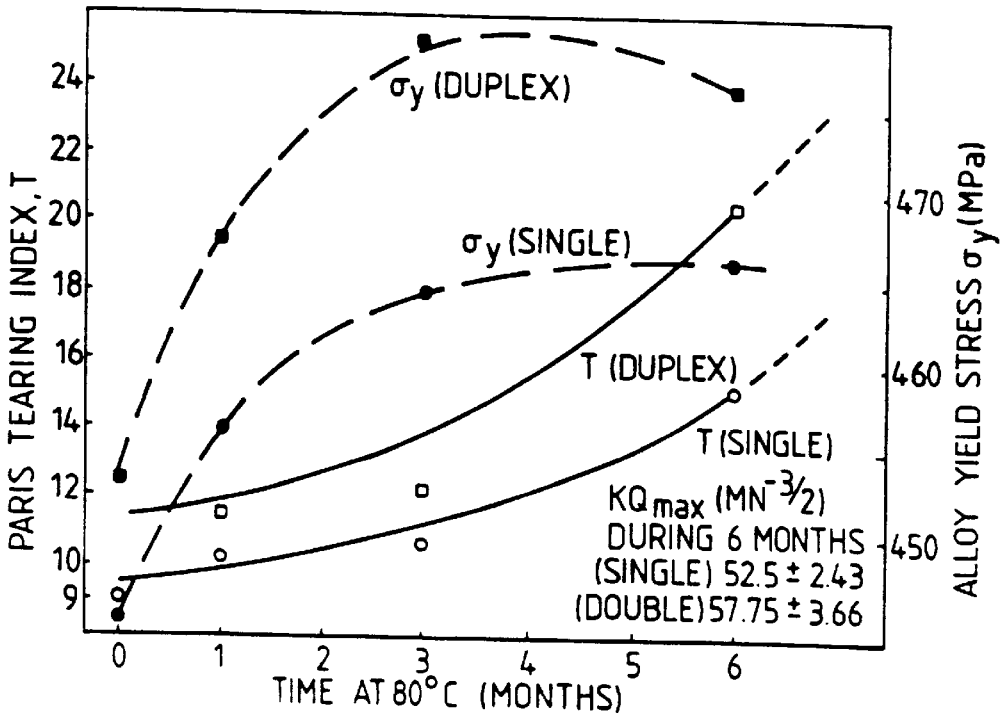
FIG. 7 is a graph of tear resistance and yield strength for material held for up to six months at 80° C. after single or duplex aging.

Duplex ageing gave a higher yield strength and a higher Paris Tear index—see FIG. 7.

To determine the stability of the material on storage after single or duplex ageing, samples were held for up to 6 months at 80° C. It was surprisingly found that both the yield strength, shown dotted on the figure and the Paris index, shown as solid lines, increased with holding time, indicating that the material became both stronger and tougher. Fracture toughness measurements on material held for 6 months at 80° C. after single or duplex ageing gave the results shown in the FIG. 7. Further tests showed that holding at a higher temperature e.g. 140° and 120° C. produced similar effects more rapidly.

In another experiment, cylinder wall sections were solution heat treated for 1 hr @475° C. followed by a cold water quench and subsequently aged for 5 hrs @180° C. i.e. an isothermal age not a duplex practice. The samples were then further aged at a range of temperatures, which were 120, 140, 160 and 180° C., and their thermal stability assessed in terms of tensile properties and fracture toughness. Comprehensive data for material treated to a final soak at 140° C. is shown in Table 15 below (values quoted are for a mean of 3 samples).

TABLE 15

| Heat Treated Condition | Fracture Toughness Kq (max.) ($MPam^{1/2}$) | Kcod ($MPam^{1/2}$) | Tearing Resistance | 0.2% Proof Stress (MPa) |
|---|---|---|---|---|
| 5 hrs @ 180° C. | 48.8 | 69.9 | 15.4 | 432 |
| + ramp to 140° C. @ 100° C./hr (0 hold) | 54.1 | 82.6 | 16.3 | 441 |
| + 4 hrs @ 140° C. | 56.6 | 83.1 | 19.5 | 448 |
| + 24 hrs @ 140° C. | 56.8 | 83.2 | 23.0 | 443 |
| + 96 hrs @ 140° C. | 61.0 | 90.9 | 32.4 | 410 |

It is quite apparent that both strength and fracture toughness increases when samples are treated at 140° C. for times up to at least 24 hrs i.e. 96 hrs shows a loss in strength. Strength also increases when treated at 120° C., and fracture toughness is expected to increase also.

Kq(max.) is the critical stress intensity calculated from the maximum load attained and the calculated crack length at that load.

$Kcod=[(2sy\ E\ dc)/(1-v^2)]^{1/2}$ is the equivalent critical stress intensity calculated from Crack Tip Opening Displacement, where sy=0.2% proof stress, E=Youngs Modulus, dc=conventional crack tip opening displacement and v=Poissons Ratio.

We claim:

1. A method of making a hollow body for a pressure container, which method comprises providing a billet of composition (in wt %)

Zn 5.0–7.0

Mg 1.5–3.0

Cu 1.0–2.7

Recrystallisation inhibitor 0.05–0.4

Fe up to 0.30

Si up to 0.15 other impurities up to 0.05 each and 0.15 in total,

Al balance said billet having a volume fraction of S phase below 1.0% extruding the billet, forming the extrusion into the shape of the desired hollow body, and over-ageing the hollow body.

2. A method as claimed in claim 1, wherein the billet has the composition:

Zn 5.0–7.0

Mg 1.5–2.5

Cu 1.8–2.2

Cr and/or Zr 0.10–0.25

Fe up to 0.15

Si up to 0.08

3. A method as claimed in claim 1, wherein the billet is homogenised at a temperature of at least 470° C. for a time sufficient to reduce the volume fraction of S phase to a value below 0.2%.

4. A method as claimed in claim 3, wherein the homogenised billet is slowly cooled to ambient temperature.

5. A method as claimed in claim 1, wherein the billet is cold or warm extruded.

6. A method as claimed in claim 5, wherein extrusion is by backward extrusion.

7. A method as claimed in claim 1, wherein forming the extrusion into the shape of the desired hollow body comprises swaging or spinning a neck at a temperature of 300–450° C.

8. A method as claimed in claim 1, wherein over-ageing is effected to an extent to reduce peak strength by 10–30%.

9. A method as claimed in claim 1, wherein over-ageing is effected by holding the hollow body at a first elevated temperature and then at a second elevated temperature higher than the first.

10. A method as claimed in claim 1, wherein over-ageing is effected by holding the hollow body at a first elevated temperature and then at a second elevated temperature lower than the first.

11. A method as claimed in claim 1, wherein over-ageing is effected by holding the hollow body at three elevated temperatures in sequence, of which the second elevated temperature is higher than the first and the third.

12. A method as claimed in claim 9, wherein one elevated temperature is within the range 80–150° C., and the other elevated temperature is within the range 160–220° C.

13. A method as claimed in claim 1, wherein the hollow body is a pressurised gas cylinder.

14. A method as claimed in claim 1, wherein the alloy contains up to 0.10% Fe.

* * * * *